United States Patent [19]

Lapp-Emden

[11] 4,361,317

[45] Nov. 30, 1982

[54] PROCESS AND APPARATUS FOR THE SINGLING OF THE SHEETS OF A PAPER STACK

[76] Inventor: Helmut Lapp-Emden, Yorkstr. 47, 4830 Gütersloh 1, Fed. Rep. of Germany

[21] Appl. No.: 138,914

[22] Filed: Apr. 10, 1980

[30] Foreign Application Priority Data

Apr. 14, 1979 [DE] Fed. Rep. of Germany ..... 2915371

[51] Int. Cl.[3] ..... B65H 1/30; B65H 3/12

[52] U.S. Cl. ..... 271/3.1; 271/12; 271/94; 271/98; 271/106

[58] Field of Search ..... 271/94, 96, 106, 99, 271/35, 97, 98, 95, 12, 13, 3.1

[56] References Cited

U.S. PATENT DOCUMENTS

| | | | |
|---|---|---|---|
| 3,258,262 | 6/1966 | Rehm | 271/94 |
| 3,312,464 | 4/1967 | Rehm | 271/96 |
| 3,406,963 | 10/1968 | Goss | 271/35 |
| 3,612,511 | 10/1971 | Godlewski | 271/35 |
| 3,620,526 | 11/1971 | Iles et al. | 271/96 |
| 3,844,551 | 10/1974 | Morrison | 271/106 |
| 3,870,294 | 3/1975 | Donner | 271/35 X |
| 3,880,419 | 4/1975 | Swanson | 271/35 X |
| 3,907,278 | 9/1975 | Jaton | 271/94 |
| 3,973,768 | 8/1976 | Shannon | 271/99 |
| 4,081,181 | 3/1978 | Crowe et al. | 271/35 X |

FOREIGN PATENT DOCUMENTS

| | | | |
|---|---|---|---|
| 1411513 | 10/1968 | Fed. Rep. of Germany | 271/94 |
| 435327 | 10/1967 | Switzerland | 271/99 |

*Primary Examiner*—Bruce H. Stoner, Jr.

*Attorney, Agent, or Firm*—Friedman, Goodman & Teitelbaum

[57] ABSTRACT

A process and apparatus for singling of sheets of a paper stack in a magazine disposed over a suction box having suction openings in a concave surface thereof transversely positioned relative to conveyance direction of a perforated endless conveyance band disposed between the stack and the suction box. A vacuum is applied to the suction box so that the lowest sheet of the stack is sucked down onto the conveyance band and conforms to the concave surface of the suction box. The lowest sheet is transported on the conveyance band, and the vacuum is switched off just before the suction openings are uncovered, at which time a blast of air is introduced into the suction box so that the next sheet of the stack is not sucked onto the conveyance band until the last sheet is removed from between the stack and the suction box. Preferably, air is injected between the lowest sheet and the next sheet from in front to prevent a vacuum formation therebetween. A second magazine system supplies the sheets of paper to the stack.

10 Claims, 5 Drawing Figures

PROCESS AND APPARATUS FOR THE SINGLING OF THE SHEETS OF A PAPER STACK

The invention relates to a process and to an apparatus for the singling of the sheets of a paper stack, especially for the subsequent addressing of envelopes, postcards or the like, in which the lowest sheet of the paper stack is attached and moved away with use of suction air.

Such a process and such an apparatus are described in German unexamined patent specification OS No. 27 21 978. According to the known process the lowest sheet of the paper stack is grasped shortly before the edge lying forward in conveyance direction and led off with use of suction air, in which process in each case the lowest sheet of stack arranged tangentially to a suction wheel above the axis is sucked from underneath over the suction wheel by application of a subpressure and is conveyed off by the suction wheel on an arcuate track with maintenance of the subpressure. There the subpressure can remain upheld in the conveyance-off until the sheet is grasped by the succeeding conveyance elements. For the promotion of the singling, air can be blown counter to the conveyance direction into the wedge-shaped space arising through the tangential arrangement of the stack.

The device for the execution of the known process consists essentially of a magazine for the paper stack and a feeder arranged under it, actable upon with suction air, for gripping and leading off individual sheets of the paper stack. The feeder is a turntable suction drum and the magazine is arranged tangentially to the suction drum mantle, there being present a stationary suction chamber immediately underneath the suction drum mantle presenting holes or slits, preferably in the zone of the tangential arrangement of the magazine. The magazine is arranged in such a way that the tangential line is shiftable forward and back as well as tiltable. Moreover, the front stop of the magazine can be elevationally adjustable. A blast air nozzle in front of the magazine provides that air is injected into the space between suction drum and magazine.

The known process, but especially the known apparatus, operate independently of format and at a very high speed without scraping strain and without interruption during the filling of the magazine. The purpose of the invention is still further to simplify the singling of sheets of a paper stack with respect to this.

With the aid of the drawing the invention is explained in detail by way of example.

Figure 1:
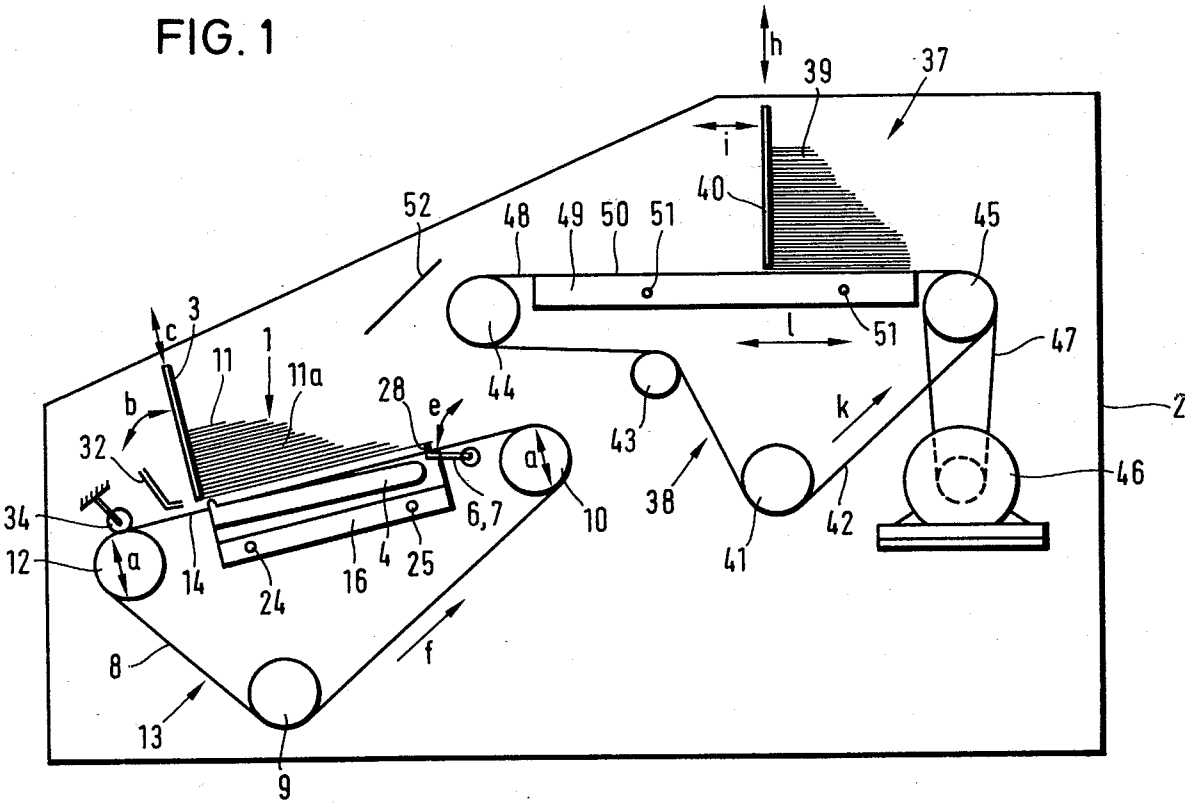
FIG. 1 shows the apparatus schematically from the side.

The apparatus of the invention for the singling of sheets of a sheet stack is arranged in the machine frame 2, in which there are borne the individual machine elements (not represented). It presents the sheet stack magazine 1, in which sheets 11 lie one upon another as stack 11*a*. These sheets 11 are to be singled. The magazine 1 is preferably—as represented—inclined forward and is bounded by the front stop 3 as well as formed below by the two front adjustable stack holders 4,5 and the two rear stack holders 6,7. The stack holder 7 is not represented in detail but lies in FIG. 1, as seen from the side behind the stack holder 6 in the picture plane. The stack 11*a*, therefore is held by the front stop 3 and carried by the stack holders 4,5 as well as 6,7.

Figure 4:
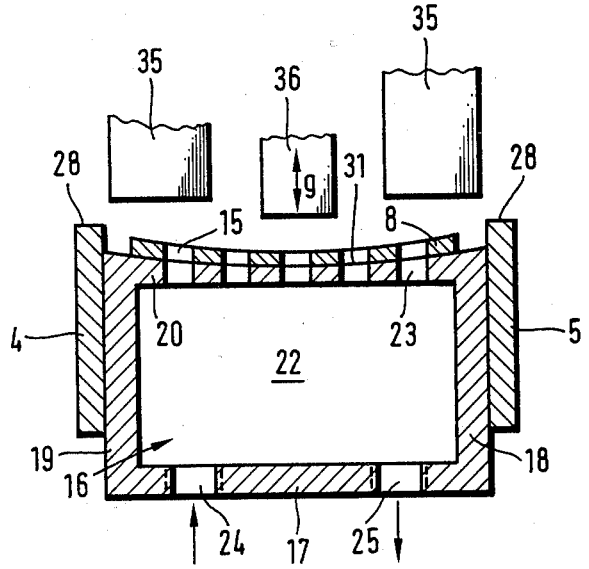
FIG. 4 is a section through the suction box along the line A—A in FIG. 3 with indicated front stop elements.

The front stop 3 is formed preferably of several rods or tongues 35,36 arranged adjacently to one another, of which at least one tongue 36 is shiftable in arrow direction g upward or downward (FIG. 4).

Under the stack 11*a* there is arranged a conveyor band system 13, which consists of the conveyance rolls 9,10,12, of which at least one is driven, and the conveyance band 8 guided over the rolls. The rolls 9, 10 and 12 are arranged spatially in a vertical plane in a triangle in such a way that the conveyance band—as represented—forms a piece 14 running preferably parallel to the lowest sheet of the stack 11*a* and along under the stack. There it is provided preferably that the inclination of the piece 14 is adjustable, for example through the elevational adjustability of a roll 10 and/or 12 (arrow direction a). Since the front stop 3 is likewise preferably swingable (arrow b) and adjustable up and down (arrow c) and, moreover, the stack holders 4,5 (arrow d, FIG. 3) and 6,7 (arrow e) are arranged to swing up or down, the entire device can be set more or less inclined or also horizontal. With the conveyance roll 12 there can cooperate expediently a contact pressure conveyance roll 34, as is represented in FIG. 1.

Figure 2:
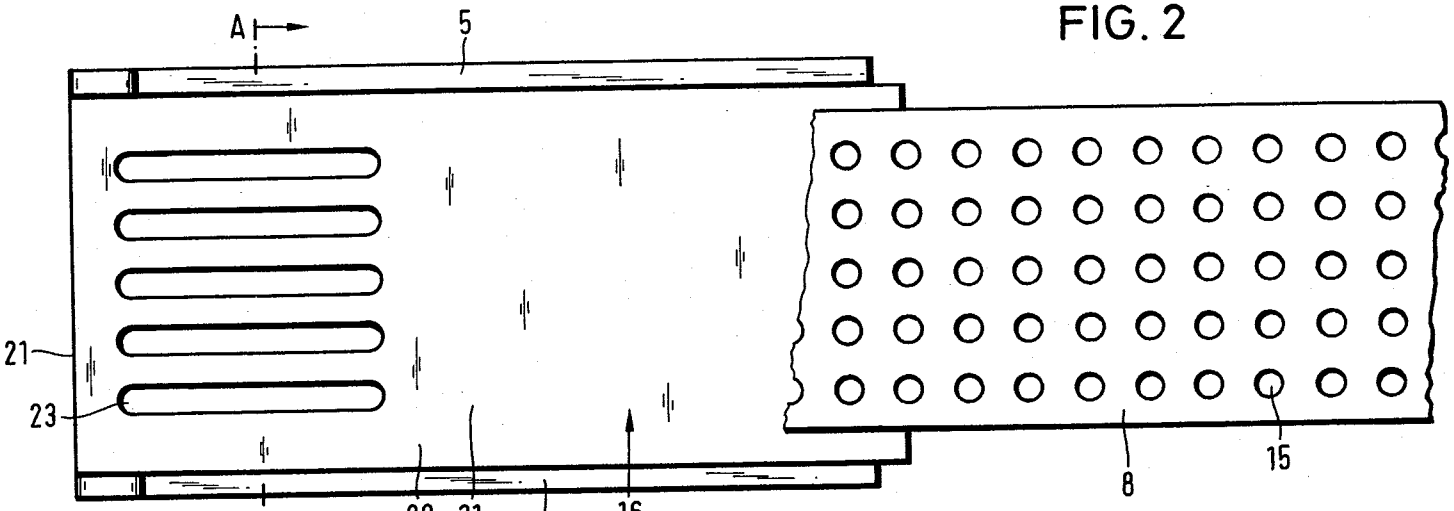
FIG. 2 is a plan view of the suction box

The conveyance band 8 is made porous, so that air can be sucked through it. Preferably there are provided holes 15 in hole rows—as represented (FIG. 2).

Under the piece 14 of the conveyance band 8 there is arranged a suction box 16. The suction box 16 consists of the bottom 17, the side walls 18, 19, the cover 20 as well as of a front wall 21 and a rear wall 22. The box, therefore, is constructed substantially closed. However, openings are provided in the cover 20, the openings being, preferably several, longitudinal slits 23 arranged parallel and adjacent to one another (FIG. 2). In the bottom 17 or a side wall 18, 19 there are provided two connection bores 24,25, into one bore of which blast air can be introduced and into the other bore vacuum or subpressure can be applied.

Figure 3:
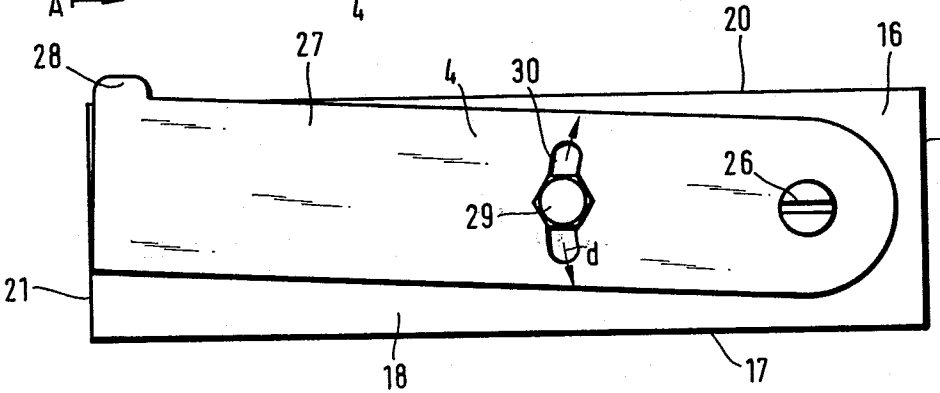
FIG. 3 is a side view of the suction box.

On the side walls 18, 19 there are arranged the stack holders 4,5 to swing about the axis 26 (FIG. 3). Each stack holder defines a swinging arm 27 which on one end pins on the axis 26 and on the other end carries on the upper edge the support lug 28, which supports the stack 11*a*. The particular position of the holder is ensured by the screw 29, which grips through the slit 30 in the holder 4 and 5, respectively, and which is screwed into a bore of the side wall 18 and 19, respectively.

According to a special form of execution of the invention the surface 31 of the cover 20 is made concave in transverse direction (FIG. 4), in which arrangement the suction band 8 fits itself with its upper piece 14 against the surface 31. The conveyance band 8 runs there in arrow direction f.

According to another form of execution of the invention a blast tube 32 is arranged in conveyance direction in front of the lower edge of the stack 11*a*, with which air can be blown against the front edge of the stack.

Figure 5:
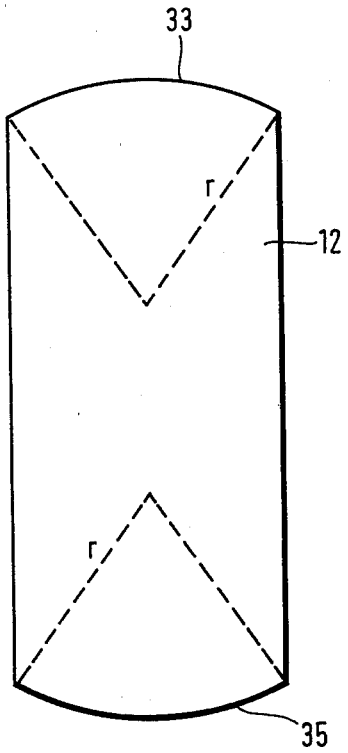
FIG. 5 is a front view of a roll of the conveyance system.

According to another form of execution of the invention at least one roll 10, 12, preferably at least the front roll 12, is crowned (FIG. 5), the radius r of the running surface 33,35 corresponding about to the radius of the concave arc of the surface 31 of the suction box 16.

The suction box 16 is connected with its bores 24, 25 with a valve-controlled vacuum and blast (blowing) air system (not represented), with which, rhythmically, a vacuum can be applied and the vacuum again broken down.

The magazine 1 of the apparatus of the invention, because of the special bearing of the stack 11*a* and for the ensuring of the sucking-on in each case of only one sheet 11, should conduct only so many sheets in the stack that by reason of the weight of the stack no sagging on the underside of the stack occurs; i.e., the underside of the stack should be insofar as possible, perfectly flat. Since the singling apparatus, however, operates very rapidly, it is only with much difficulty possible to refill the magazine 1 by hand with interruption of the feeding. For this reason, ahead of the magazine 1 there is preferably arranged another magazine 37 which communicates with a conveyance band system 38. The magazine 37 is constructed in shaft form and has a great capacity, so that it can receive a relatively large sheet stack 39. The magazine 37 spatially arranged over the magazine 1 is represented in FIG. 1 merely with the front wall 40, which is adjustable in arrow direction h and i. The bottom of the magazine is formed at least in part by the likewise perforated conveyance band 42, which is executed in correspondence to the perforated conveyance band 8 and is conducted endlessly over the rolls 41, 43, 44 and 45 (FIG. 1). Preferably the roll 45 is drivable by the motor 46 over a belt 47. The perforated conveyance band 42 runs there in arrow direction k.

Under the horizontal piece 48 of the conveyance band 42 there is arranged a suction box 49, the surface 50 of which is constructed flat, but likewise presents longitudinal slits which are executed in correspondence to the slits 23 of the suction box 16. The suction box 49, however, has several groups of slits in succession. Further, the suction box has connecting bores 51 for hose lines of a vacuum system (not represented).

The entire conveyance system 38 is preferably adjustable forward and back in arrow direction 1.

The apparatus of the invention operates as follows: The conveyance band 8 runs endlessly in arrow direction f. Vacuum is applied rhythmically to the suction box 16. As soon as the subpressure is applied the lowest sheet 11 of the stack 11*a* is sucked onto the surface of the perforated conveyance band 8. Through the fact that the conveyance band 8 is perforated the vacuum can act on the lowest sheet and the attracted sheet, as a result of the vacuum, sticks to the conveyance band 8 and is conveyed onward by this until the sheet is gripped by the roll 34 and conveyed onward. The vacuum is then switched off and preferably decomposed, as blast air is blown into the suction box. There, the sheet, however, should insofar as possible still cover the slits 23, so that no further sheet is sucked by the same vacuum phase. Through these measures the following sheet of the stack is prevented from directly following the preceding sheet, which, especially in the case of small sheets is not to be avoided if the vacuum is not broken down. Thus, especially this process step makes the singling certain. Moreover, the lowest sheet of the stack 11*a*, which rests on the lugs 28 of the holders 4,5 and the hlders 6,7, through the arrangement of the slits 23 in the zone in front of the front stop 3 in the front edge zone is fitted with a concave bend onto the conveyance band 8, it being supported, furthermore, on the lugs 28 of the holders 4,5. Thus, the degree of sag can be selected with the elevational adjustment of the lugs 28 and thereby be attuned to the sheet quality. Through the suddenly occuring bending of the lowest sheet there arises a subpressure between the lowest sheet and the following one. With the blast tube 32 air is blown against the front edge of the stack, which through its penetration between the lower sheets prevents vacuum formation between adjacent sheets. The bent-through sheet can only be conveyed off when it has slipped past the tongues 36 downward and is thereby freed. The adjustment of the tongues 36 is governed likewise according to the sheet quality. What is essential for the interplay between the suction box 16 and the transport band 8 is that the transport (conveyance) band comes to lie constantly on the concave surface of the suction box. This is ensured especially by the feature that at least one of the rolls 10, 12 is crowned and the culmination point of the crowned roll (highest point) lies aligned in one plane with the lowest place of the concave arc of the surface 31 of the suction box 16. This effect was surprising.

The suction or vacuum phase is relatively brief and lasts, as described, only until the sheet is grasped by the roll 34 and conveyed onward with usual-type other conveyance means (not represented). The vacuum is then switched off and by injection of air into the suction box is broken down. There, no excess pressure should arise. In the next vacuum beat, which is valve-controlled in the same manner as the blowing (blast) phase, the next sheet is grasped and conveyed off, the distance from the preceding sheet being determined by the vacuum frequency and being selectable. The adjustabilities of the installation (arrows a,b,c,d,e,f,g) are utilized in correspondence to the properties of the sheets and do not, therefore, need to be explained in detail. They bring about, however, a considerable number of possibilities of variation, which, in particular, ensure the independence from format and quality of the apparatus according to the invention. The same holds for the adjustabilities of the magazine installation 37,38 (arrows h, i, k, l).

The magazine installation 37,38 is coupled in control technique with the singling installation. When in the magazine 1 a certain level of the stack 11*a* is reached, the transport system 38 is set in operation, a continuous subpressure being applied to the suction box 49. Thereby, as a rule, the sheets are drawn in fishscale form from the magazine 37 onto the perforated conveyance band 42 and transformed from the conveyance band into the magazine 1. The sheets lie as a scale stream on the suction box, so that the vacuum does not need to be shut off when the conveyance band is at a standstill and the magazine 1 is just not refilled. The scale stream covers the slits of the suction box, so that the vacuum is maintained. The sheets are expediently guided by one or more guide plates 52 that are arranged between magazine 11 and roll 44 into the magazine, in which operation inter alia the setting angle of the guide plates contributes for a faultless true-edge stacking of the sheets in the magazine 1. Since the speed of the conveyance system 38 is preferably greater than that of the conveyance system 13, the magazine 1 can be refilled with any desired quality.

The invention, therefore, with very simple means provides a very rapidly operating apparatus which realizes a process that ensures a certain singling of the sheets of a stack. It is even possible to single over 70,000 sheets per hour.

I claim:

1. Apparatus for singling of sheets of a paper stack comprising:

a magazine for holding the stack;

a perforated endless conveyance band disposed under said magazine for individually transporting the sheets of the stack;

a suction box disposed below said conveyance band having an upper cover member supporting said conveyance band, said cover member having a concave surface transversely positioned relative to the transporting direction of said conveyance band, suction openings being provided in said cover member facing said magazine, said cover member being disposed below the lowest sheet of the stack positioned in said magazine;

first means through which a vacuum is applied to said suction box to provide a subpressure therein;

second means for grasping the lowest sheet when the lowest sheet is being transported but before the lowest sheet uncovers said suction openings of said suction box, at which time the vacuum is switched off to decompose the subpressure in said suction box;

third means through which a blast of air is introduced into said suction box when the vacuum is switched off so that the next sheet of the stack is not sucked onto the conveyance band at this time; and said magazine and said suction box being inclined in the conveyance direction, a front stop being provided in front of said magazine, two front adjustable stack holders being disposed underneath said magazine, and two rear stack holders being disposed to the rear of said magazine and spaced from said front holders, the front and rear positions corresponding to the conveyance direction.

2. Apparatus according to claim 1, wherein said first means includes a first bore in said suction box, and said third means includes a second bore in said suction box.

3. Apparatus according to claims 1 or 2, wherein said second means includes a contact-pressure conveyance counter-roll which engages the last sheet before said suction openings are uncovered.

4. Apparatus according to claim 3, wherein said conveyance band is guided over a plurality of conveyance rolls, one of said conveyance rolls cooperating with said counter-roll, and at least one of said conveyance rolls being driven.

5. Apparatus according to claim 1, wherein said front stop includes several rods arranged adjacent to one another, at least one of said front stop rods being shiftable up and down.

6. Apparatus according to claim 1, wherein said front stack holders swing about an axis on side walls of said suction box, each front stack holder including a swinging arm having one end pivoting on said axis and an opposite end provided with a supporting lug on an upper edge thereof for supporting the stack.

7. Apparatus according to claim 6, wherein a screw connects each swinging arm to its associated side wall, said screw extending through a slit in said swinging arm and being threaded into a bore in said side wall.

8. Apparatus according to claim 1, wherein air injecting means is disposed in the conveyance direction in front of a lower edge of said magazine for injecting air between the lowest sheets of the stack, said air injecting means including an air blast tube.

9. Apparatus according to claim 1, wherein a second magazine coacts with said first mentioned magazine to supply sheets of paper thereto, said second magazine being provided with a conveyance band system, a bottom of said second magazine being defined at least partially by a perforated conveyance band of said conveyance band system that is guided endlessly over a plurality of rolls, at least one of said rolls being driven, a second suction box disposed under said second magazine, said second suction box having longitudinal slits in a cover member facing said second magazine, and means through which a vacuum is applied to said suction box to provide a subpressure therein.

10. Apparatus for singling of sheets of a paper stack comprising:

a magazine for holding the stack;

a perforated endless conveyance band disposed under said magazine for individually transporting the sheets of the stack;

a suction box disposed below said conveyance band having an upper cover member supporting said conveyance band, said cover member having a concave surface transversely positioned relative to the transporting direction of said conveyance band, suction openings being provided in said cover member facing said magazine, said cover member being disposed below the lowest sheet of the stack positioned in said magazine;

first means through which a vacuum is applied to said suction box to provide a subpressure therein;

second means for grasping the lowest sheet when the lowest sheet is being transported but before the lowest sheet uncovers said suction openings of said suction box, at which time the vacuum is switched off to decompose the subpressure in said suction box;

third means through which a blast of air is introduced into said suction box when the vacuum is switched off so that the next sheet of the stack is not sucked onto the conveyance band at this time; and said conveyance band being guided over a plurality of conveyance rolls, at least one of said conveyance rolls being driven, one of said rolls being a front roll disposed in front of said magazine in the conveyance direction, at least said front roll being crowned on its running surface, the radius of said running surface of said crowned front roll corresponding to the radius of said concave surface of said cover member of said suction box, with a highest point of said crowned front roll being in alignment with a lowest place of said concave surface of said cover member.

* * * * *